US010134548B2

(12) United States Patent
Ryu

(10) Patent No.: US 10,134,548 B2
(45) Date of Patent: Nov. 20, 2018

(54) VACUUM INTERRUPTER

(71) Applicant: LSIS CO., LTD., Gyeonggi-do (KR)

(72) Inventor: Jae-Seop Ryu, Gyeonggi-do (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 15/493,194

(22) Filed: Apr. 21, 2017

(65) Prior Publication Data

US 2018/0182579 A1 Jun. 28, 2018

(30) Foreign Application Priority Data

Dec. 22, 2016 (KR) ..... 10-2016-0176746

(51) Int. Cl.
*H01H 33/662* (2006.01)
*H01H 33/664* (2006.01)
*H01H 33/666* (2006.01)

(52) U.S. Cl.
CPC .... *H01H 33/66207* (2013.01); *H01H 33/664* (2013.01); *H01H 33/666* (2013.01);
(Continued)

(58) Field of Classification Search
CPC ..... H01H 33/66207; H01H 33/664; H01H 33/66238; H01H 33/666; H01H 33/66261;
(Continued)

(56) References Cited

U.S. PATENT DOCUMENTS 2,965,734 A 12/1960 Timmerman
4,071,727 A * 1/1978 Crouch ..... H01H 33/66238 200/83 D
(Continued)

FOREIGN PATENT DOCUMENTS

DE 2725092 A1 12/1978
EP 0402818 A1 12/1990
(Continued)

OTHER PUBLICATIONS

Translation of DE2725092 (original doc. published Dec. 14, 1978).*
(Continued)

*Primary Examiner* — Edwin A. Leon
*Assistant Examiner* — William Bolton
(74) *Attorney, Agent, or Firm* — K&L Gates LLP

(57) ABSTRACT

The present disclosure relates to a vacuum interrupter that is installed within a vacuum circuit breaker to break a circuit. The vacuum interrupter includes an insulated container, a seal cup, a fixing electrode, a diaphragm, and a movable electrode. The insulated container is formed in a cylindrical form. The seal cup is installed on an upper end of the insulated container. The fixing electrode includes a fixing shaft and a fixing contact member installed on the other end of the fixing shaft. The diaphragm is installed on a lower end of the insulated container. The movable electrode includes a movable shaft having one end fixed to the diaphragm and the other end disposed within the insulated container and formed to be linearly movable, and a movable contact member installed on the other end of the movable shaft to be selectively contacted to the fixing contact member.

4 Claims, 4 Drawing Sheets

(52) U.S. Cl.
CPC ..... *H01H 33/66238* (2013.01); *H01H 33/66261* (2013.01); *H01H 2033/66223* (2013.01); *H01H 2033/66276* (2013.01); *H01H 2033/66292* (2013.01)

(58) Field of Classification Search
CPC ..... H01H 2033/66276; H01H 2033/66292; H01H 2033/66223
USPC ..... 218/139, 134, 136, 155, 118
See application file for complete search history.

(56) References Cited

U.S. PATENT DOCUMENTS 4,088,859 A * 5/1978 Hruda ..... H01H 9/04 200/83 D
4,272,661 A * 6/1981 Dethlefsen ..... H01H 33/666 218/142
6,864,456 B1 * 3/2005 Banghard ..... H01H 33/66207 218/123
8,519,812 B2 * 8/2013 Kim ..... H01H 33/664 335/201
8,754,346 B2 * 6/2014 Harada ..... H01H 33/6644 218/154
2006/0266739 A1 * 11/2006 Takahashi ..... H01G 5/14 218/136
2012/0210799 A1 * 8/2012 Motoyama ..... G01L 19/145 73/716

FOREIGN PATENT DOCUMENTS

EP 1202312 A1 5/2002
JP 2007-305497 A 11/2007
JP 4643149 B2 3/2011
JP 4849088 B2 12/2011
KR 10-1103668 B1 1/2012
KR 10-1650925 B1 8/2016

OTHER PUBLICATIONS

European Search Report for related European Application No. 17166825.4; report dated Oct. 19, 2017; (8 pages).

* cited by examiner (Prior Art)

VACUUM INTERRUPTER

CROSS-REFERENCE TO RELATED APPLICATIONS

This application claims the priority of Korean Patent Application No. 10-2016-0176746 filed on Dec. 22, 2016, in the Korean Intellectual Property Office, the disclosure of which is hereby incorporated by reference in its entirety.

BACKGROUND

1. Technical Field

The present disclosure relates to a vacuum interrupter that is installed within a vacuum circuit breaker to break a circuit.

2. Description of the Related Art

In general, a vacuum circuit breaker is a kind of circuit breaker that is installed in a high voltage power system and configured to break a circuit to protect a power system when dangerous situations such as a short circuit, an overcurrent, or the like occur, and is designed utilizing excellent insulation performance and arc extinction capability in a vacuum state.

Such vacuum circuit breaker breaks the circuit in a vacuum extinction mode in a vacuum interrupter (VI) within the vacuum circuit breaker when an abnormal current occurs to protect people and load devices.

In detail, as illustrated in FIG. 1, a vacuum interrupter 1 according to the related art may include a insulated container 10 in a vacuum state, a fixing seal cup 20 and a movable seal cup 30 that are disposed on an upper end and a lower end of the insulated container 10 to seal an interior of the insulated container 10, a fixing electrode 40 disposed in an upward direction of the interior of the insulated container 10, and a movable electrode 50 disposed below the fixing electrode 40.

Accordingly, when the movable linearly moves in a vertical direction to be connected to the fixing electrode 40, a state in which the current may flow may be established and the current may be supplied to a load side from a power side. On the contrast, when the abnormal current occurs, the movable electrode 50 may be disconnected from the fixing electrode 40 to break the current supplied to the load side from the power side.

Meanwhile, in order to linearly move the movable electrode 50 in the vertical direction, a bellows 50 having a spring shape may be installed in the vertical direction around the movable electrode 50. Accordingly, since a length of the insulated container 10 is increased by a length of the bellows 60, there was a problem that material cost is increased at the time of manufacturing the insulated container 10.

In addition, since an entire length of the vacuum interrupter 1 is increased as the length of the insulated container 10 is increased, there was a problem that an installation area within the vacuum circuit breaker is increased.

SUMMARY

It is an aspect of the present disclosure to provide a vacuum interrupter having a reduced length of an insulated container by removing a bellows installed in a vertical direction in the insulated container and installing a diaphragm having a disc shape formed stretchably in the vertical direction on a lower end of the insulated container.

In accordance with one aspect of the present disclosure, a vacuum circuit breaker includes an insulated container, a seal cup, a fixing electrode, a diaphragm, and a movable electrode. The insulated container is formed in a cylindrical form having a hollow, and a top and a bottom thereof are opened. The seal cup is installed on an upper end of the insulated container. The fixing electrode includes a fixing shaft having one end fixed to the seal cup and the other end disposed within the insulated container, and a fixing contact member installed on the other end of the fixing shaft. The diaphragm is installed on a lower end of the insulated container to seal an interior of the insulated container, and is formed in a disc form of a concave and convex shape having an opened center so as to be stretchable in a vertical direction. The movable electrode includes a movable shaft having one end fixed to the diaphragm and the other end disposed within the insulated container and formed to be linearly movable, and a movable contact member installed on the other end of the movable shaft to be selectively connected to the fixing contact member.

DETAILED DESCRIPTION

Figure 1:
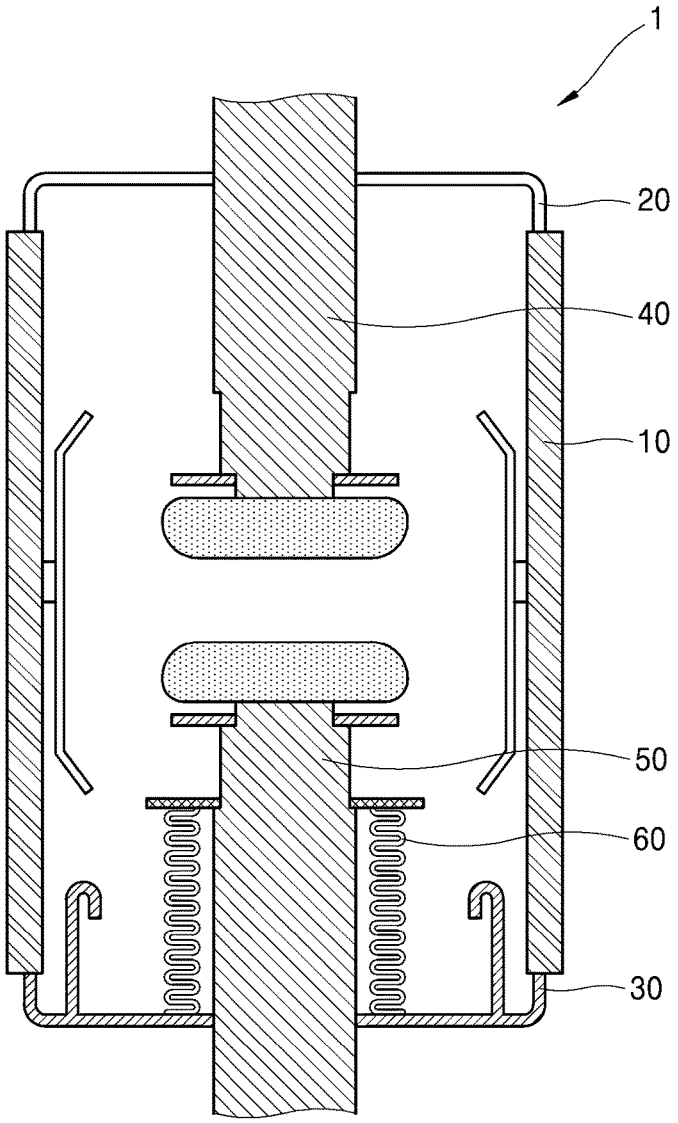
FIG. 1 is a cross-sectional view of a vacuum interrupter according to the related art.

Hereinafter, a vacuum interrupter according to exemplary embodiments of the present disclosure will be described in detail with reference to the accompanying drawings. In the specification, like configurations will be denoted by like reference numeral, and repeated descriptions and descriptions of known functions and configurations that may unnecessarily obscure the gist of the present disclosure will be omitted. The exemplary embodiments of the present disclosure are provided to more fully describe the present disclosure to those skilled in the art. Accordingly, the shapes, sizes, etc. of components in the drawings may be exaggerated for clarity of description.

Figure 2:
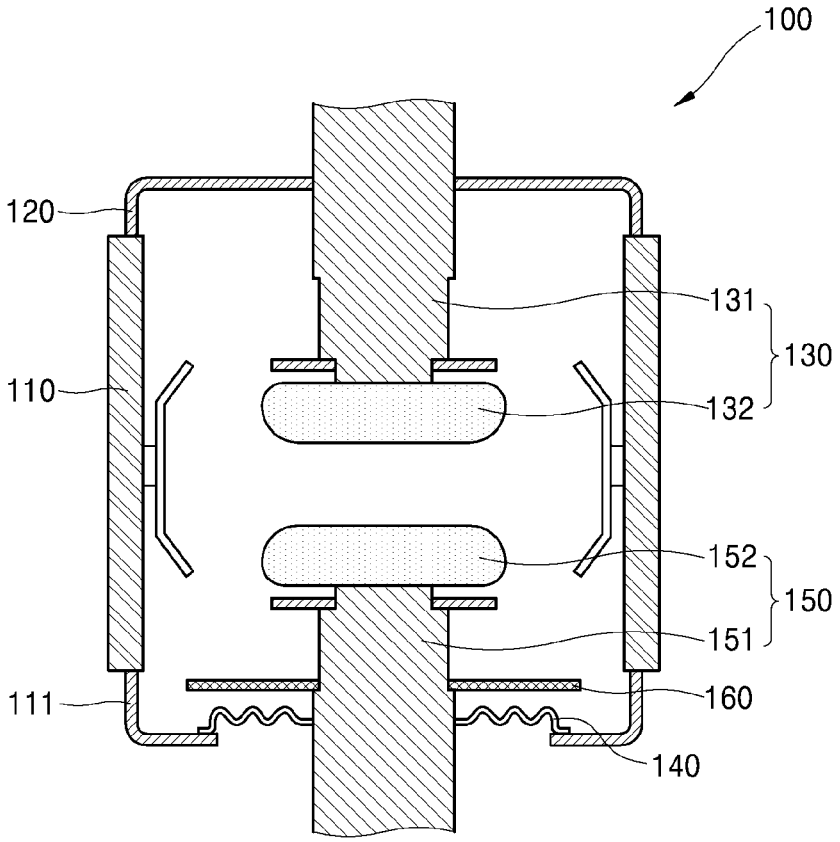
FIG. 2 is a cross-sectional view of a vacuum interrupter according to an exemplary embodiment in the present disclosure.

FIG. 2 is a cross-sectional view of a vacuum interrupter according to an exemplary embodiment in the present disclosure.

As illustrated in FIG. 2, a vacuum interrupter 100 includes an insulated container 110, a seal cup 120, a fixing electrode 130, a diaphragm 140, and a movable electrode 150.

The insulated container 110 has a shape that a top and a bottom thereof are opened. Specifically, the insulated container 110 may be formed in a cylindrical shape in which a hollow is formed, and an interior thereof may be maintained in a vacuum state by a seal cup 120 and a diaphragm 140 to be described below. In addition, the insulated container 110 may be formed of a ceramic material to secure insulation property.

The seal cup 120 is installed on an upper end of the insulated container 110. Specifically, the seal cup 120 may be formed of stainless steal having excellent strength, and is fixed to the upper end of the insulated container 110 to serve to maintain air tightness within the insulated container 110 together with the diaphragm 140 to be described below.

The fixing electrode 130 includes a fixing shaft 131 and a fixing contact member 132.

One end of the fixing shaft 131 is fixed to the seal cup 120, and the other end thereof is disposed in the insulated container 110. Specifically, the fixing shaft may be formed of a conductive material, and may have a rod shape to be connected to a power side or a load side.

The fixing contact member 131 is installed on the other end of the fixing shaft 131. Specifically, the fixing contact member 132 may be formed of a conductive material, and may have a disc shape to be disposed in the insulated container 110.

At least one diaphragm 140 may be formed stretchably in a vertical direction. In addition, the diaphragm 140 is installed on the lower end of the insulated container 110 to seal the interior of the insulated container 110 together with the seal cup 120.

Specifically, the diaphragm 140 may be formed in a disc form of a concave and convex shape having an opened center. As such, as the diaphragm 140 is formed in the concave and convex shape, the diaphragm 140 is stretchable in the vertical direction even though it is formed of a metallic material.

In addition, an inner circumference surface of the diaphragm 140 may be fixed to a movable shaft 151 of a movable electrode 150 to be described below, and an outer circumference surface thereof may be fixed to the insulated container 110. Here, since the diaphragm 140 is formed of the metallic material, it may be fixed to the movable electrode 150 and the insulated container 110 by thermal bounding, more preferably, welding.

Meanwhile, the diaphragm 140 may be directly installed on the lower end of the insulated container 110, but may be installed on the insulated container 110 using a separate connection member 111 for stable coupling.

The movable electrode 150 includes a movable shaft 151 and a movable contact member 152.

One end of the movable shaft 151 is fixed to the diaphragm 140, and the other end thereof is disposed in the insulated container 110, such that the movable shaft 151 may be linearly moved. That is, as the diaphragm 140 is formed stretchably in the vertical direction, the movable shaft 151 connected to the diaphragm 140 may be moved in the vertical direction.

Specifically, one end of the movable shaft 151 may be disposed to be exposed to the outside of the diaphragm 140, and a driving part (not shown) that linearly moves the movable shaft 151 in the vertical direction may be mounted on the exposed portion. In addition, similarly to the fixing shaft 131, the movable shaft 151 may be formed of a conductive material, and may have a rod shape to be connected to a power side or a load side.

The movable contact member 152 is installed on the other end of the movable shaft 151 to be selectively connected to the fixing contact member 132. Specifically, the movable contact member 152 may be formed of a conductive material, and may have a disc shape to be disposed in the insulated container 110.

As such, as the movable contact member 152 is installed on the other end of the movable shaft 151, the movable contact member 152 may be connected to or disconnected from the fixing contact member 132 while linearly moving in the vertical direction together with the movable shaft 151.

Accordingly, when the movable contact member 152 is connected to the fixing contact member 132, a state in which a current may flow may be established, and the current may be supplied to the load side from the power side. In addition, when an abnormal current such as an overcurrent, or the like occurs, the movable contact member 152 is disconnected from the fixing contact member 132, to break the current supplied to the load side from the power side.

Meanwhile, an arc shield 160 may be disposed between the movable contact member 152 and the diaphragm 140. This is to protect the diaphragm 140 from an arc generated as the fixing electrode 130 and the movable electrode 150 are connected to and disconnected from each other.

The arc shield 160 may be fixed on an outer circumference surface of the movable shaft 151. Specifically, the arc shield 160 may be formed in a disc shape having an insertion hole formed at the center thereof, and a step may be formed on the outer circumference surface of the movable shaft 151 in order to install the arc shield 160 on the outer circumference surface of the movable shaft 151. Accordingly, when the insertion hole is inserted into the fixing shaft 131, one surface of the arc shield 160 may be seated on the step and the arc shield 160 may be fixed to the outer circumference surface of the movable shaft 151.

As described above, as the diaphragm 140 formed stretchably in the vertical direction is installed on the lower end of the insulated container 110, a length of the insulated container 110 may be reduced. That is, according to the related art, since a bellows having a spring shape is mounted in the vertical direction in the insulated container 110 to move the movable electrode 150, there was a disadvantage that the length of the insulated container 110 is increased by a basic length of the bellows, however, according to the present disclosure, since the diaphragm 140 having the disc shape having stretchable property is installed on the lower end of the insulated container 110, it is possible to reduce the length of the insulated container 110.

Accordingly, it is possible to prevent the waste of the material used to manufacture the insulated container 110. In addition, since the entire length of the vacuum interrupter 100 may be reduced by the reduced length of the insulated container 110, an installation area of the vacuum interrupter 100 disposed within the vacuum circuit breaker may also be reduced.

Figure 3:
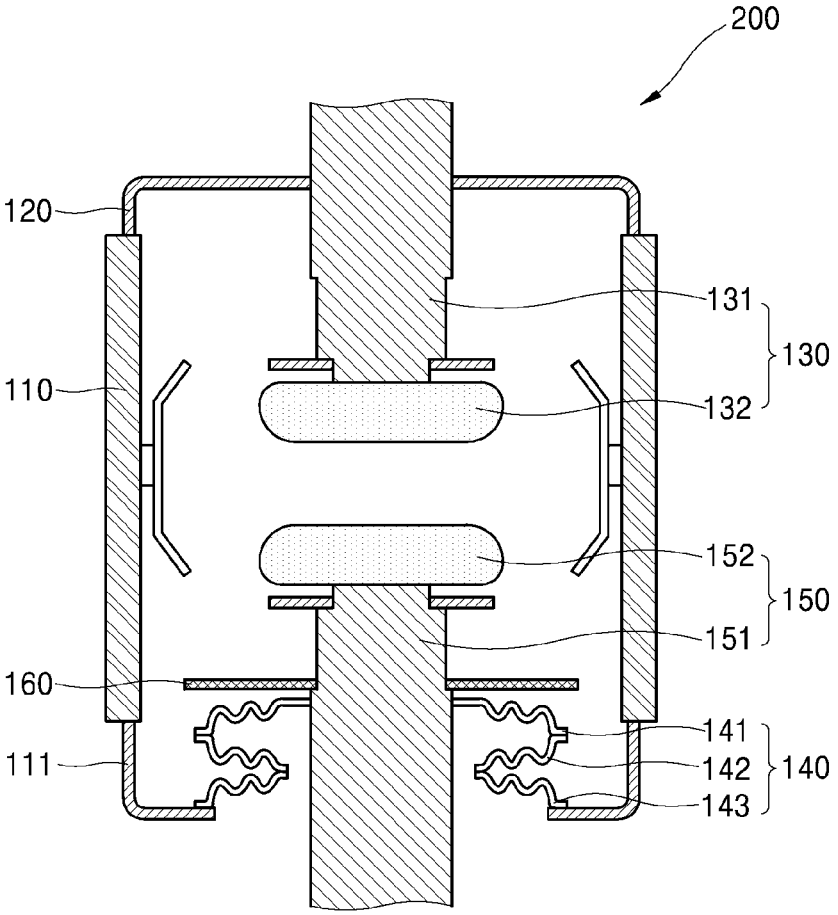
FIGS. 3 and 4 are cross-sectional views according to exemplary embodiments different from that of FIG. 2.

FIG. 3 is a cross-sectional view of a vacuum interrupter according to another exemplary embodiment in the present disclosure. In the present exemplary embodiment, differences from the exemplary embodiment described above will be mainly described.

As illustrated in FIG. 3, the diaphragm 140 of a vacuum interrupter 200 according to another exemplary embodiment includes a first diaphragm 141, a second diaphragm 142, and a third diaphragm 143.

The first diaphragm 141 is formed in a disc form of a concave and convex shape having an opened center, and an inner circumference surface thereof is fixed to the outer circumference surface of the movable shaft 151. In this case, the first diaphragm 141 may be installed within the insulated container 110, and an outer circumference surface thereof may be disposed to be spaced apart from the insulated container 110.

The second diaphragm 142 is formed in a disc form of a concave and convex shape having an opened center, and an outer top surface thereof is fixed to an outer bottom surface of the first diaphragm 141. In this case, the second diaphragm 142 may be installed within the insulated container 110, an outer circumference surface thereof may be disposed to be spaced apart from the insulated container 110, and an inner circumference surface thereof may be disposed to be spaced apart from the movable shaft 151.

The third diaphragm 143 is formed in a disc form of a concave and convex shape having an opened center, an inner top surface thereof is fixed to an inner bottom surface of the second diaphragm 142, and an outer side surface thereof is fixed to the insulated container 110. In this case, an inner circumference surface of the third diaphragm 143 may be disposed to be spaced apart from the movable shaft 151. In addition, an outer circumference surface of the third diaphragm 143 may also be directly fixed to the insulated container 110, but may be fixed to the insulated container 110 using the separate connection member 111 for stable coupling.

As such, as a plurality of diaphragms 140 are provided, displacement is increased, which may lead to an increase in a movement distance of the movable electrode 150.

Figure 4:
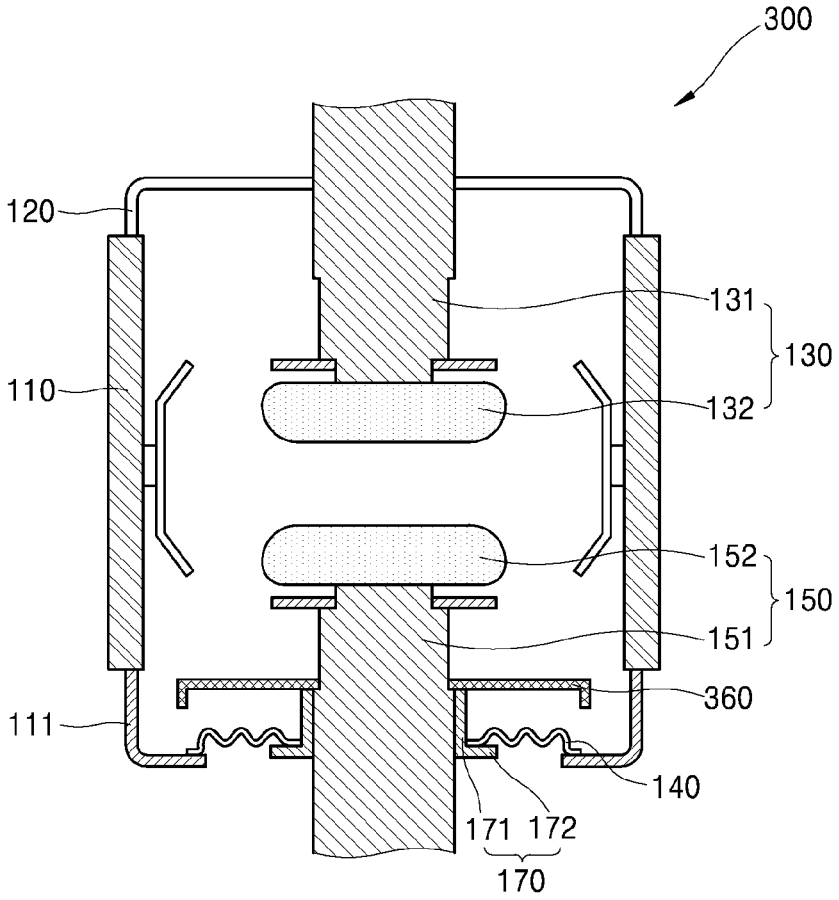

FIG. 4 is a cross-sectional view of a vacuum interrupter according to still another exemplary embodiment in the present disclosure. In the present exemplary embodiment, differences from the exemplary embodiment described above will be mainly described.

As illustrated in FIG. 4, a vacuum interrupter 300 according to another exemplary embodiment may further include a body part 171 including a guide hole into which the movable shaft 151 is inserted, and a guide member 170 including a protrusion 172 that is outwardly extended from a lower end portion of the body part 171.

As such, as the vacuum interrupter 300 further includes the guide member 170, the movable shaft 151 may be moved in the vertical direction along the guide hole of the body part 171. Thus, since it is prevented that the movable shaft 151 is shook in a horizontal direction when it moves, the movable shaft 151 may be moved linearly and more stably.

In this case, the diaphragm 140 may be installed between the guide member 170 and the insulated container 110. Specifically, an inner bottom surface of the diaphragm 140 may be adhered to a top surface of the protrusion 172, and an outer bottom surface thereof may be fixed to the insulated container 110, more particularly, to an inner top surface of the connection member 111.

Meanwhile, an arc shield 360 may be disposed on the outer circumference surface of the movable shaft 151. Specifically, an end of the arc shield may be disposed between the diaphragm 140 and the insulated container 110, and may be bent in a downward direction.

As such, since the end of the arc shield 360 is bent in the downward direction, it is possible to prevent a phenomenon that the arc generated as the fixing electrode 130 and the movable electrode 150 are connected to and disconnected from each other is concentrated on an outer circumference of the diaphragm 140.

According to the present disclosure, since the diaphragm formed stretchably in the vertical direction is installed on the lower end of the insulated container, it is possible to reduce a length of the insulated container. That is, according to the related art, since a bellows having a spring shape is mounted in the vertical direction in the insulated container to move the movable electrode, there was a disadvantage that the length of the insulated container is increased by a basic length of the bellows, however, according to the present disclosure, since the diaphragm having the disc shape having stretchable property is installed on the lower end of the insulated container, it is possible to reduce the length of the insulated container.

Accordingly, it is possible to prevent the waste of the material used to manufacture the insulated container. In addition, since the entire length of the vacuum interrupter may be reduced by the reduced length of the insulated container, the installation area of the vacuum interrupter disposed within the vacuum circuit breaker may be reduced.

Although the present disclosure has been described with reference to the exemplary embodiments shown in the accompanying drawings, it is only an example. It will be understood by those skilled in the art that various modifications and equivalent other exemplary embodiments are possible from the present disclosure. Therefore, the scope of the present disclosure should be defined only by the following claims.

What is claimed is:

1. A vacuum interrupter comprising:

a hollow insulated container having opened top and bottom;

a seal cup installed on an upper end of the insulated container;

a fixing electrode including a fixing shaft having one end fixed to the seal cup and the other end disposed within the insulated container, and a fixing contact member installed on the other end of the fixing shaft;

at least one diaphragm installed on a lower end of the insulated container to seal an interior of the insulated container, and formed stretchably in a vertical direction, wherein the diaphragm is not a bellows;

a movable electrode including a movable shaft having one end fixed to the diaphragm and the other end disposed within the insulated container and formed to be linearly movable, and a movable contact member installed on the other end of the movable shaft to be selectively contacted to the fixing contact member, wherein the diaphragm is formed in a disc form of a concave and convex shape having an opened center; and a guide member disposed within the insulated container, wherein the guide member includes:

a body part having a guide hole into which the movable shaft is inserted; and a protrusion extending outwardly from a lower end portion of the body part, wherein a first end of the diaphragm is coupled to a top surface of the protrusion, which prevents the movable shaft from moving in a horizontal direction, wherein the diaphragm is installed on the insulated container using a separate connection member, wherein a step is formed on an outer circumference surface of the movable shaft, wherein an arc shield is disposed between the movable contact member and the diaphragm and is fixed to an outer circumference surface of the movable shaft, wherein the arc shield is configured to protect the diaphragm from an arc generated from the fixing electrode and the movable electrode, and wherein one surface of the arc shield is seated on the step.

2. The vacuum interrupter of claim 1, wherein the diaphragm has an inner circumference surface fixed to the movable shaft and an outer circumference surface fixed to the insulated container.

3. The vacuum interrupter of claim 1, wherein the diaphragm includes:

a first diaphragm having an inner circumference surface fixed to the outer circumference surface of the movable shaft, a second diaphragm having an outer top surface fixed to an outer bottom surface of the first diaphragm, and a third diaphragm having an inner top surface fixed to an inner bottom surface of the second diaphragm and an outer side surface fixed to the insulated container.

4. The vacuum interrupter of claim 1, wherein an end of the arc shield is disposed between the diaphragm and the insulated container, and is formed in a shape bent in downward direction.

* * * * *